US010315318B2

(12) United States Patent
Spencer, Jr. et al.

(10) Patent No.: US 10,315,318 B2
(45) Date of Patent: Jun. 11, 2019

(54) CUSHION BACK CUTTER

(71) Applicant: Crain Cutter Company, Inc., Milpitas, CA (US)

(72) Inventors: Darwin D. Spencer, Jr., Milpitas, CA (US); Tan Dinh Nguyen, Milpitas, CA (US); Gregory Joseph Chambers, Morgan Hill, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 177 days.

(21) Appl. No.: 15/051,313

(22) Filed: Feb. 23, 2016

(65) Prior Publication Data

US 2017/0239824 A1 Aug. 24, 2017

(51) Int. Cl.
*B26B 5/00* (2006.01)
*B26B 29/06* (2006.01)

(52) U.S. Cl.
CPC ..... *B26B 5/005* (2013.01); *B26B 5/006* (2013.01); *B26B 29/06* (2013.01)

(58) Field of Classification Search
CPC ..... B26B 5/005; B26B 29/06; B26B 5/006; A47G 27/0487
See application file for complete search history.

(56) References Cited

U.S. PATENT DOCUMENTS 2,238,678 A * 4/1941 Cook ..... B26B 5/005 26/8 R
2,304,332 A * 12/1942 Bodkin ..... B26B 5/006 30/320
2,336,284 A * 12/1943 Nelson ..... B26B 5/006 30/333
2,452,148 A * 10/1948 Rhodes ..... B23D 51/03 30/517
2,464,206 A * 3/1949 Becker ..... B26B 3/04 30/304
2,537,287 A * 1/1951 Thomas ..... A47G 27/0487 30/294
2,567,102 A * 9/1951 Cook ..... D03D 39/24 30/162
3,337,955 A * 8/1967 Poletajev ..... B26B 5/00 112/130

(Continued)

OTHER PUBLICATIONS

"Crain Floor Covering Tools Catalog 2011," 2011, 1 page.
"Row-Glide™ Top Cutter," Magnum Master Installer Series, Orcon Corporation, (undated), 2 pages.

*Primary Examiner* — Jonathan G Riley
(74) *Attorney, Agent, or Firm* — Fenwick & West LLP

(57) ABSTRACT

A cushion back cutter is formed from a first side plate, a second side plate, and a center plate between the first and second side plates. The center plate includes a slot that forms a blade holding pocket with a bottom opening to receive one or more blades. A blade clamp is inserted into the blade clamp opening of the first side plate, and a blade clamp fastener tightens to cause the blade clamp to press the blades against the second side plate to hold the blades in position. The center side plate forms a row guide for guiding the blades of the cutter between adjacent rows of carpet tufts. The row guide may include a region having continuous notches, which tend to move the carpet tufts out of the path of the blades to avoid shearing them.

17 Claims, 9 Drawing Sheets

(56) References Cited

U.S. PATENT DOCUMENTS 3,363,314 A * 1/1968 O'brien ..... A47G 27/0487 30/125
3,543,400 A * 12/1970 McPherson ..... A47G 27/0487 30/280
3,543,401 A * 12/1970 McPherson ..... A47G 27/0487 30/294
3,621,573 A * 11/1971 Summers ..... B26B 5/005 30/287
3,934,341 A * 1/1976 Carlson ..... B26B 5/005 30/287
4,095,341 A * 6/1978 Crain ..... B26B 5/005 30/287
4,148,142 A * 4/1979 Sullivan ..... B26B 5/005 30/293
4,620,368 A * 11/1986 Bowman ..... B26B 5/005 30/294
5,159,758 A * 11/1992 MacDonald ..... B26B 5/005 30/289
5,353,508 A * 10/1994 Baker ..... A47G 27/0487 30/293
6,112,417 A * 9/2000 Hyer ..... B26B 29/06 30/290
6,421,923 B1 * 7/2002 Nguyen ..... B26B 5/005 30/287
6,421,924 B2 7/2002 Anderson et al.
6,792,634 B1 * 9/2004 Mills ..... A47G 27/0487 7/103
6,951,055 B1 * 10/2005 Collins ..... B26B 1/048 30/125
D649,425 S * 11/2011 Bunnag ..... D8/98
2001/0054236 A1 * 12/2001 Anderson ..... B26B 5/005 30/294
2003/0140504 A1 * 7/2003 Shannon ..... B26B 29/06 30/294
2012/0017450 A1 * 1/2012 Hetts ..... B26B 5/005 30/315
2012/0198703 A1 * 8/2012 Ranieri ..... B26B 5/002 30/162

* cited by examiner

CUSHION BACK CUTTER

BACKGROUND

This invention relates generally to flooring tools, and in particular to cushion back cutters. A cushion back cutter is a tool for precisely trimming the edges of carpet seams in preparation for making the seams. As shown in FIG. 1, a prior art cushion back cutter 100 has a body 110; a row separator 115; a row guide 120 that is a straight, thin, beveled surface forming the bottom of the cutter; a blade holding pocket 125 for holding a slotted razor blade 130; and a blade thumbscrew 140. FIG. 2 shows greater detail of one slotted razor blade 130 that is commonly used in the carpet installation trade and in particular with cushion back cutters. Slotted razor blade 130 is generally rectangular in shape, and both long sides have edges 132 that are sharpened along their entire length. Slotted razor blade 130 also includes central slot 134.

As shown in FIG. 1, to install slotted razor blades 130 into the prior art cushion back cutter, blade thumbscrew 140 must first be unscrewed and completely removed. Next, the user inserts the blades in the bottom of blade holding pocket 125 (which has an opening in the bottom of the cutter). Blade thumbscrew 140 can then be re-inserted through a hole in one side of the body, through the central slot 134 in the slotted razor blade 130, and can be tightened into a nut (not shown) welded onto the outside of the opposite side of the body. The slotted razor blade can be extended or retracted from bottom of row guide 120 by loosening the blade thumbscrew 140 and moving the blade inwardly or outwardly from within the blade holding pocket 125.

The angle A of the blade holding pocket 125 holds the slotted razor blade 130 at an angle A of approximately 30° so that a surface B of an edge 132 is exposed to cut the carpet's backing. Surface B is long and cuts with a slicing action. This improves cutting efficiency and blade life, which is important when cutting through coarse carpet backings with thick attached cushions. The distance C between the bottom of the row guide 120 and the bottom corner of slotted razor blade 130 determines the depth of cut. The thicker the carpet's backing, the greater the distance the slotted razor blade 130 must be extended. When the desired depth of cut is established, blade thumbscrew 140 is tightened down, and the cutter is ready to trim seam edges.

Carpet tufts are inserted into carpet backing material in lines. To use cushion back cutter 100, the front of the cutter at row separator 115 is first used as a kind of divider to start a small parted area between two lines of carpet tufts. Once the small parted area is formed, the cutter is pushed forward at handle 180 and row guide 120 maintains the part between the lines of tufts. As shown in FIG. 8, once row guide 115 enters a row between a left line of tufts 201 and a right line of tufts 202, row guide 115 is able to guide the forward motion of the cutter and to position slotted razor blade 130 between the rows of tufts. Thus, as slotted razor blade 130 moves forward with the cutter, the slotted razor blade 130 should cut through the carpet's backing 203, including any attached cushion 204, but should not cut into carpet tufts.

In prior art cushion back cutters, a single slotted razor blade may be inserted into the blade holding slot of the cutter, or a number of them may be inserted. In some prior art cushion back cutters, two or more slotted razor blades are inserted within the same blade holding slot, but only one of them is extended to a cutting position to trim the seam edge (with the others being retracted into blade holding slot). As disclosed in U.S. Pat. No. 3,453,401 to Scott, two slotted razor blades are inserted, but only one is extended to a cutting position, to cut closely to the carpet tufts on the left or right side of a carpet row as desired. When the blade cuts closely to the tufts, a minimum amount of carpet backing will remain at the finished seam, which can reduce unsightly gaps between the tufts. Alternatively, as disclosed in U.S. Pat. No. 3,453,401 to Anderson, the cutter may hold three blades in order to cut left, right, or dead center (as may be required on certain carpets).

Prior art cushion back cutters are economically produced by spot welding stamped sheet metal parts together. As shown in FIG. 3, the prior art cushion back cutter 100 includes a left side plate 150, a center plate 160, and a right side plate 170, all of which are spot welded together to form the body 110 of the cutter. A slot 162 in center plate 160 provides the necessary space to form blade holding pocket 125 in the middle of the cutter that receives slotted razor blades 130. Left side plate 150 and right side plate 170 form the left and right walls of blade holding pocket 125. Center plate 160 includes a bottom bevel 164 forming the row guide 120 of the cutter. Left side plate 150 includes a blade thumbscrew hole 152 and a blade window 154 marked with blade window graduations 156 for setting blade depth. Right side plate 170 includes a nut 172 spot welded onto its outer surface for blade thumbscrew 140.

A problem with the prior art cushion back cutter 100 relates to blade change. Slotted razor blades 130 become dull after trimming long lengths of carpet seam edges, and must be changed repeatedly. Moreover, because the slotted razor blade is sharpened on both edges 132, and because only surface B (FIG. 1) of the blade 130 is being used for actual cutting, the slotted razor blade can be removed from the cutter, rotated, and re-used up to three more times after the first edge becomes dull. But this requires that the user perform the required steps to change or rotate a blade.

As shown in FIG. 3, to change or rotate a slotted razor blade 130, blade thumbscrew 140 must be completely unscrewed and removed from the cutter. This is because blade thumbscrew 140 runs through central slot 134 in slotted razor blades 130. Removing blade thumbscrew 140 is time-consuming and can result in loss of the thumbscrew, which is an expensive part. Furthermore, the maximum depth that the slotted razor blade can cut is limited by the upper end 135 of central slot 134 of slotted razor blade 130 hanging up on blade thumbscrew 140.

It would therefore be desirable to have some other means to hold the blades that did not pass a screw through their central slot, which could improve efficiency of blade change and rotation and might also allow the blade to be extended further to cut thicker carpet backings and attached cushion.

As shown in FIG. 1, another problem with the prior art cushion back cutter 100 relates to the row guide 120 forming the base of the cutter. In prior art cushion back cutters, row guide 120 is formed as a continuous, straight bottom surface on cushion back cutter 100. In some cushion back cutters, the row guide 120 may be beveled to improve its ability to penetrate and follow between the lines of carpet tufts.

However, because row guide 120 is formed as a straight and continuous surface, if a carpet tuft becomes trapped beneath row guide 120, it remains trapped until it is eventually sheared off by a slotted razor blade 130. Due to variations in manufacturing, individual carpet tufts frequently encroach the area between rows of tufts where the cushion back cutter needs to pass. As a result, carpet tufts can be run over and can become trapped by row guide 120 and inadvertently sheared off. If carpet tufts are sheared off by the blade, this will result in gaps in the tufts at the seam. This can produce an unsightly seam, particularly on patterned carpet.

It would therefore be desirable to have some means to prevent carpet tufts from becoming trapped beneath the row guide, which could reduce shearing off of the carpet tufts and thereby produce better looking seams.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 4:
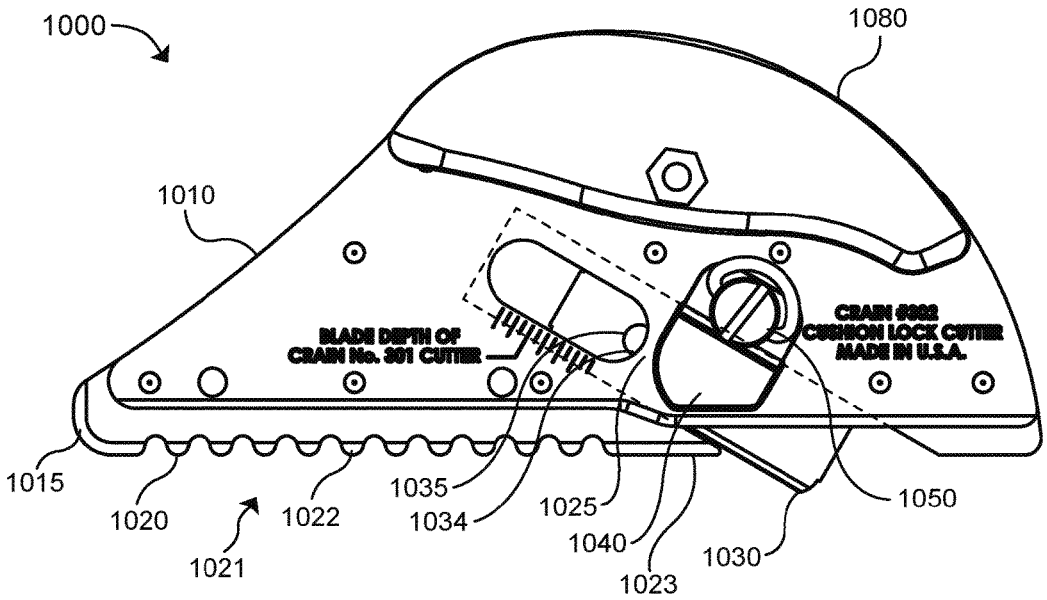
FIG. 4 illustrates a side view of a cushion back cutter, in accordance with an embodiment of the invention.

As shown in FIG. 4, cushion back cutter 1000 has a body 1010, a row separator 1015, a row guide 1020, a blade holding pocket 1025, and a handle 1080. At least one slotted razor blade 1030 can be inserted into blade holding pocket 1025, though blade holding pocket 1025 may be formed wider to accept two or three blades. In addition, cushion back cutter 1000 includes a blade clamp 1040 and a blade clamp thumbscrew 1050. Blade clamp thumbscrew 1050 is offset or fastened "outside the perimeter" of slotted razor blade 1030, and need not pass through the central slot 1034 of slotted razor blade 1030.

To install blades, blade clamp thumbscrew 1050 need only be loosened a few turns, without having to be removed, which in turn loosens blade clamp 1040. Afterwards, slotted razor blades 1030 can be inserted into the bottom opening of blade holding pocket 1025. As slotted razor blades 1030 are inserted further into blade holding pocket 1025, they easily slide beneath blade clamp 1040. When a desired depth of cut is set, blade clamp 1040 can be tightened down on an outside surface of a slotted razor blade 1030 by re-tightening blade clamp thumbscrew 1050, and all blades will be held at their desired positions.

Figure 1:
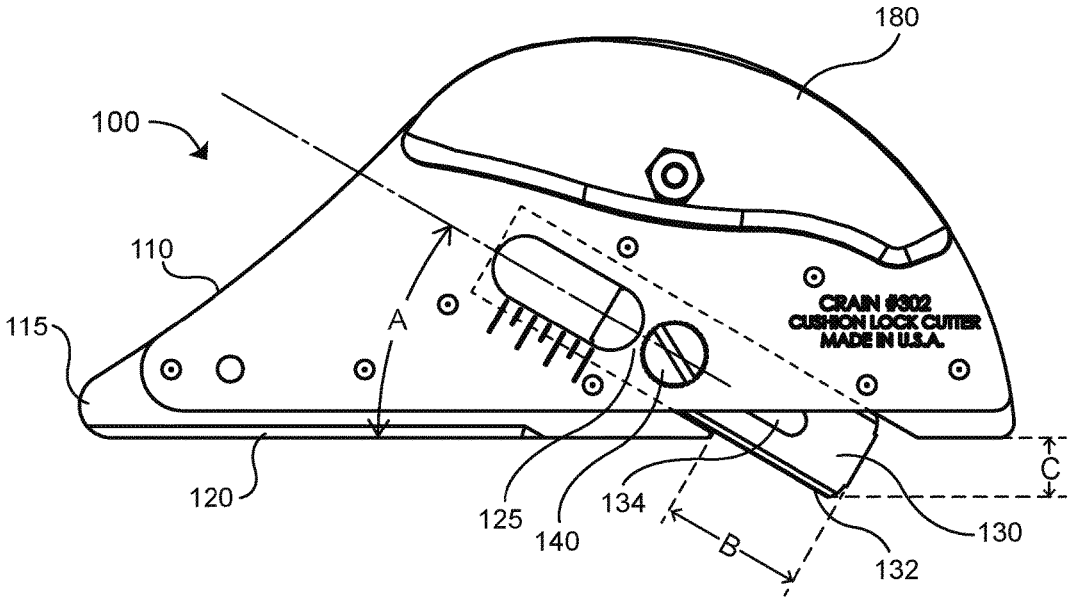
Figure 1 Prior Art
FIG. 1 illustrates a prior art cushion back cutter.
Figure 2:
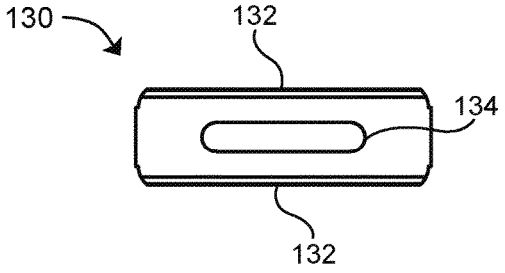
Figure 2 Prior Art
FIG. 2 illustrates a slotted razor blade usable in a cushion back cutter, such as the prior art cushion back cutter shown in FIG. 1.
Figure 3:
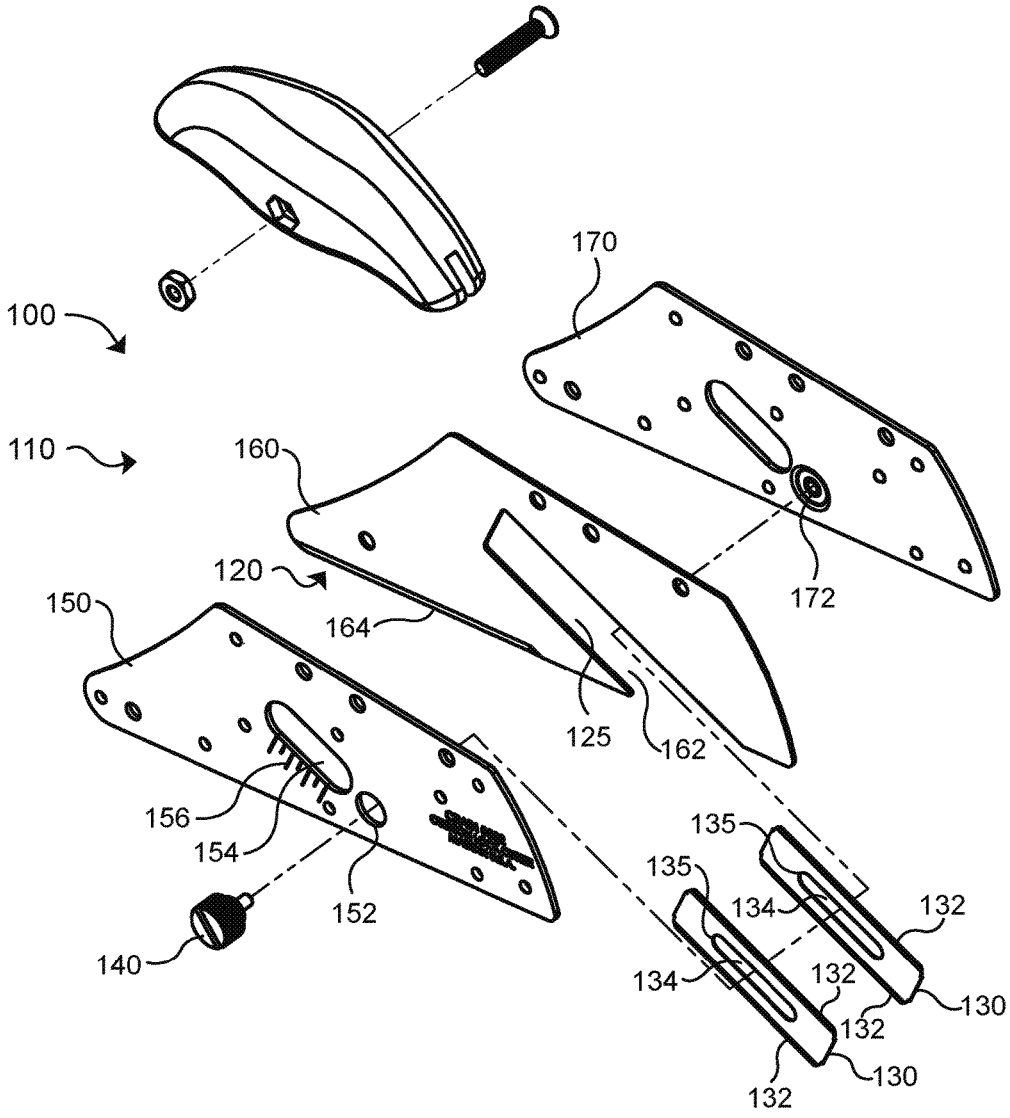
Figure 3 Prior Art
FIG. 3 illustrates an exploded view of the prior art cushion back cutter of FIG. 1.
Figure 6:
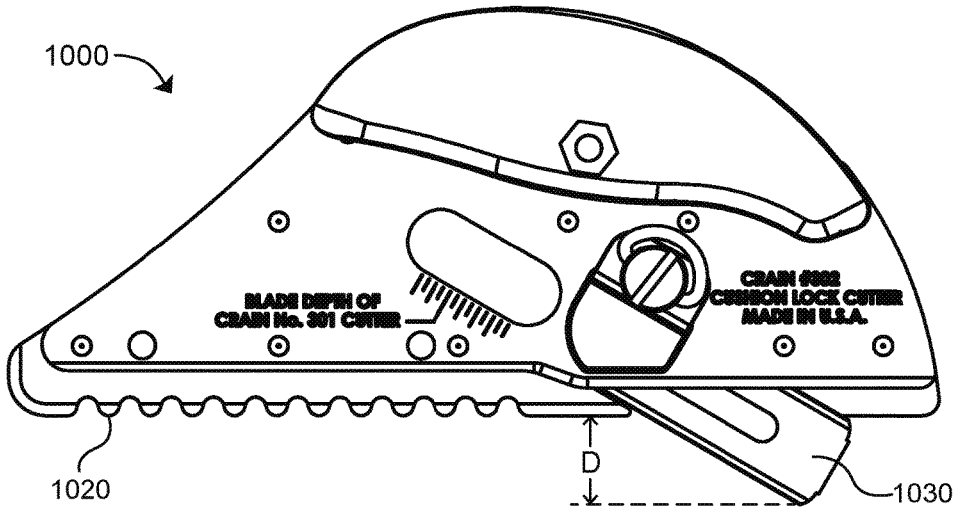
FIG. 6 illustrates a side view of the cushion back cutter of FIG. 4, with the slotted razor blade 1030 extended.

Blade clamp 1040 presses on an outer surface of a slotted razor blade 1030 to hold it in position. As a result, the depth of cut of slotted razor blade 1030 is not limited by the blade clamp screw 1050 hanging up on an upper end 1035 of central slot 1034. As shown in FIG. 6, when installed in cushion back cutter 1000, slotted razor blade 1030 can be clamped into position with its bottom corner extended further from row guide 1020. This results in a depth of cut D that is greater than depth of cut C of the prior art cushion back cutter 100 shown in FIG. 1. This allows cushion back cutter 1000 to cut through carpets with thicker backings, or even to double cut two overlapping pieces of carpet, as is sometimes necessary.

As shown in FIG. 4, cushion back cutter 1000 also has a row guide 1020 with a series of notches 1021. Notches 1021 are rounded in shape and continuous along a portion of row guide 1020. Notches 1020 allow carpet tufts (which may become trapped beneath row guide 1020) the opportunity to escape from beneath the row guide 1020 before being cut. In particular, the carpet tufts have an opportunity to stand up into their natural position if temporarily released from downward pressure by the relief provided by any of notches 1021. Furthermore, notches 1021 tend to push any trapped carpet tufts aside as they pass by or across the tufts. Thus, in two different ways, notches 1021 act to reduce the problem of carpet tufts becoming trapped beneath the row guide 1020 and eventually being sheared off by a slotted razor blade 1030.

In one embodiment, the notches have a depth that is greater than the thickness of a carpet tuft for which the cutter is designed. For example, the notches may have a depth of at least 0.100 inches. In another embodiment, the notches have a continuous contour to avoid trapping any carpet tufts.

Row guide 1020, in addition to having notches 1021, also includes a bevel 1022 formed on its bottommost surface. Both the notched area formed by notches 1021 as well as straight area 1023 of row guide 1020 have this bevel 1022. Bevel 1022 helps row guide 1020 including notches 1021 and straight area 1023 penetrate as deeply as possible into the tight area between two lines of carpet tufts and to pass through this area smoothly.

The beveled straight area 1023 of row guide 1020 establishes the final part between the left and right lines of carpet tufts after notches 1021 have cleared as many carpet tufts as possible. This ensures that the parted carpet tufts will not re-enter the area directly in front of slotted razor blade 1030 and as a result be sheared off.

Figure 5:
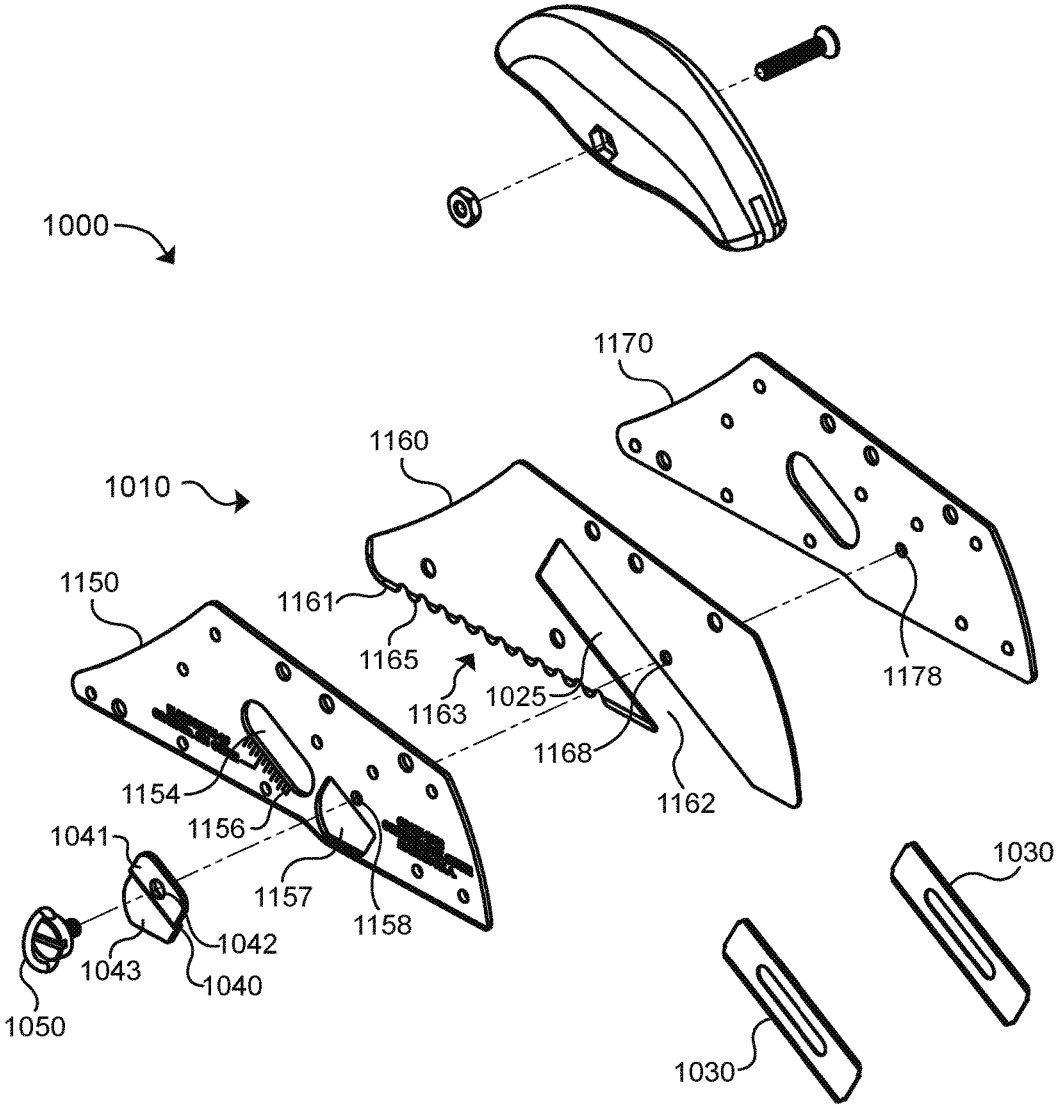
FIG. 5 illustrates an exploded view of the cushion back cutter of FIG. 4.

FIG. 5 shows the exploded view of cushion back cutter 1000, which includes a left side plate 1150, a center plate 1160, and a right side plate 1170, all of which are spot welded together to form a body 1010. Center plate 1160 includes a slot 1162, which provides space to form blade holding pocket 1025 in the middle of the cutter to receive slotted razor blades 1030. Left side plate 1150 and right side plate 1170 form the left and right walls of blade holding pocket 1025. Center plate 1160 additionally includes a row guide 1161, notches 1163, and a bottom bevel 1165 formed on notches 1163 and continuing all the way to slot 1162. Left side plate 1150 includes a blade window 1154 and blade window graduations 1156, both to assist in setting the depth of cut of slotted razor blades 1030. Left side plate 1150 additionally includes a blade clamp opening 1157 and a blade clamp screw passage hole 1158, which is positioned outside the perimeter of the position of blades 1030 once they are inserted into blade holding pocket 1025. Center plate 1160 has a blade clamp screw passage hole 1168 in a position corresponding with blade clamp screw passage hole 1158 of left side plate 1150. Right side plate 1170 also includes a nut forming a blade screw tapped hole 1178 spot welded to its outer surface in a position corresponding with blade clamp screw passage hole 1158 of left side plate 1150.

Blade clamp 1040 includes an upper portion 1041 with a blade clamp screw passage hole 1042 and an offset bottom portion 1043 that steps down from upper portion 1041. Bottom portion 1043 of blade clamp 1040 is insertable into blade clamp opening 1157 of left side plate 1150. Blade clamp thumbscrew 1050 is inserted through blade clamp screw passage hole 1042 of blade clamp 1040, through blade clamp screw passage hole 1158 of left side plate 1150, through blade clamp screw passage hole 1168 of center plate 1160, and threaded into a nut forming blade screw tapped hole 1178 that is spot welded onto an outer surface of right side plate 1170. When blade clamp thumbscrew 1050 is tightened down onto upper portion 1041 of blade clamp 1040, the lower portion 1043 is pressed against slotted razor blades 1030 to hold them in their desired positions.

Figure 7:
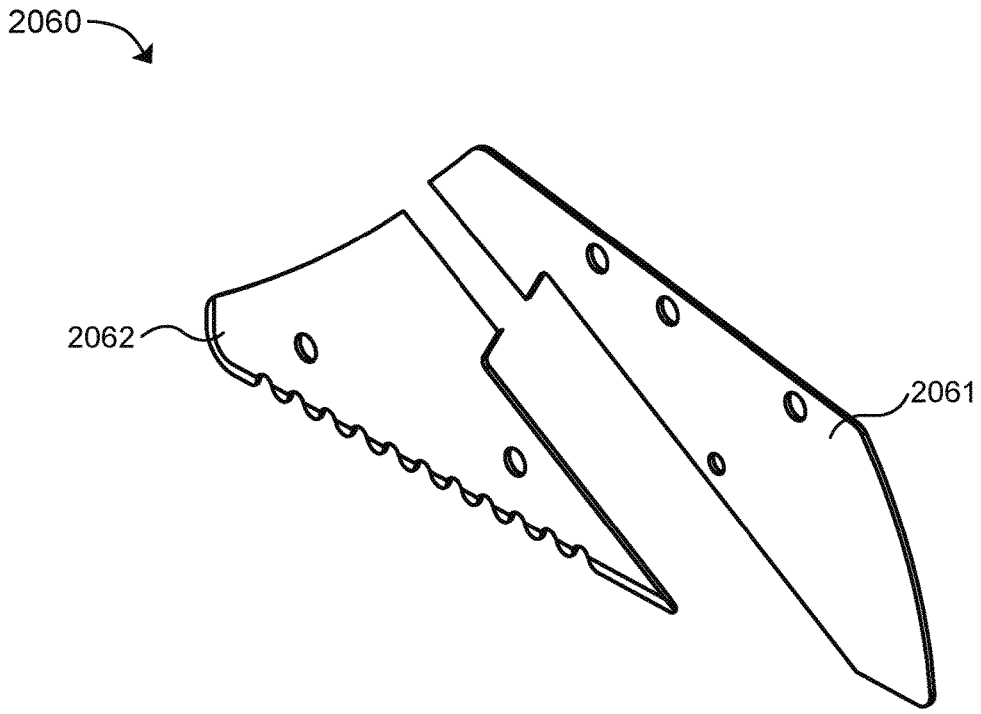
FIG. 7 illustrates an alternative embodiment of a center plate 2060 for use with the cushion back cutter of FIG. 4.
Figure 8:
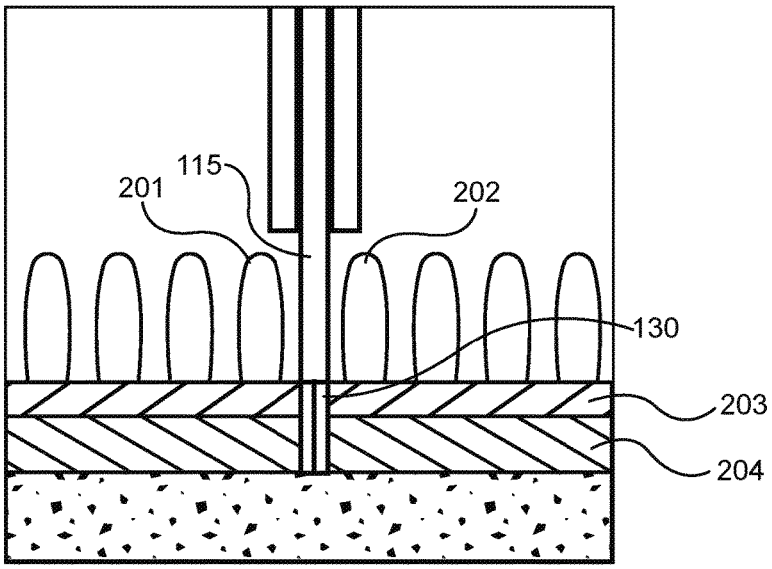
FIG. 8 illustrates a front view of a prior art cushion back cutter inserted between two rows of carpet tufts.

FIG. 7 shows center plate 2060, which is an alternative embodiment of the center plate 1160 shown in FIG. 5. Center plate 2060 includes an upper portion 2061 and a lower portion 2062. Upper portion 2061 and lower portion 2062 can be spot welded with left side plate 1150 and right side plate 1170 (both shown in FIG. 5) to produce a body similar to body 1010 of FIG. 4. However, lower portion 2062 can be processed separately from upper portion 2061 in automated industrial processes, such as batch de-burring. Such processes can produce bending in a part shaped like the center plate 1160 of FIG. 5, making it unable to be spot welded. This is because the center plate 1160 of FIG. 5 has a large area removed at slot 1162, which makes it prone to being bent by such processes.

Figure 9:
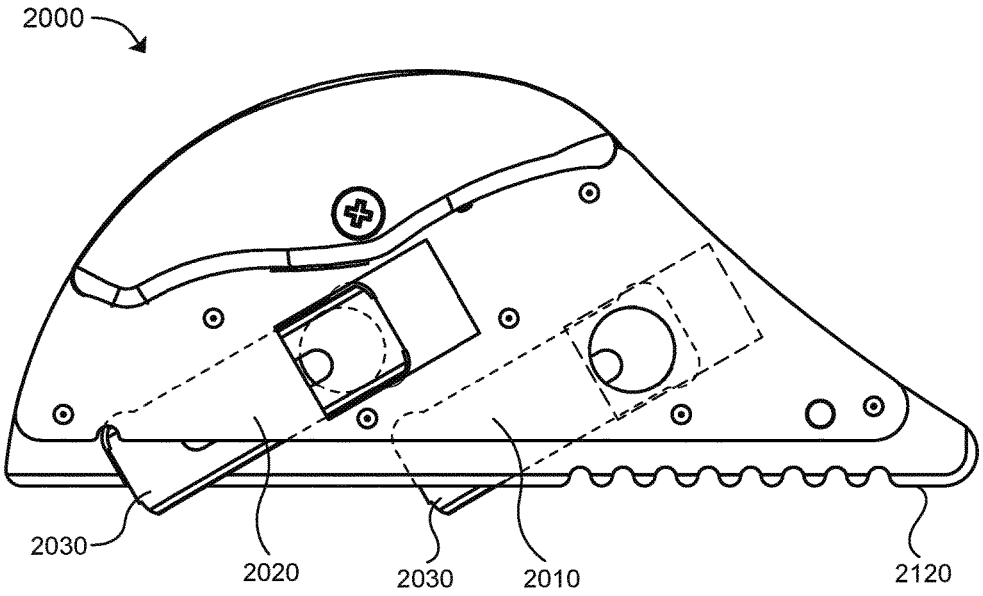
FIG. 9 illustrates a side view of a cushion back cutter, in accordance with another embodiment of the invention.
Figure 10:
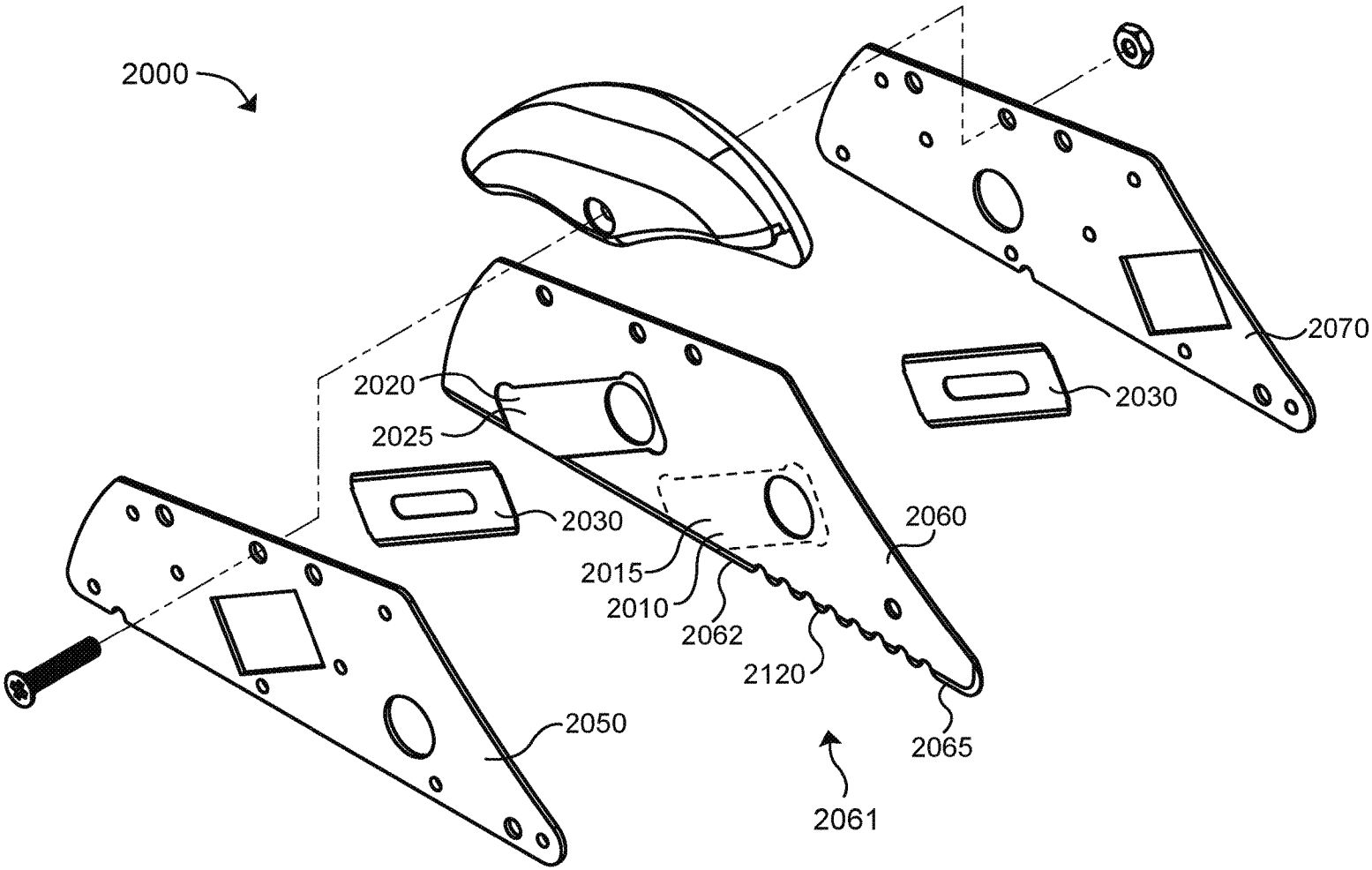
FIG. 10 illustrates an exploded view of the cushion back cutter of FIG. 9.

Alternative embodiments of cushion back cutters, and other types of carpet seam cutters that include a row guide, may include notches on the row guide to reduce shearing of carpet tufts. FIG. 9 shows cushion back cutter 2000, which is an alternative embodiment of the cushion back cutter 1000 of FIG. 4. Cushion back cutter 2000 includes front pocket 2010 and rear pocket 2020 for holding two slotted razor blades 2030. As shown in FIG. 10, space for slotted razor blades 2030 is created by machining a front pocket 2015 in the left (back) side and a rear pocket 2025 in the right (front) side of center plate 2060. When left side plate 2050 and right side plate 2070 are positioned in relation to center plate 2060, front blade pocket 2010 and rear blade pocket 2020 are formed for holding slotted blades 2030. Thus, slotted razor blades 2030 slide into cushion back cutter 2000 and are held in a cutting position by the perimeter defined by front pocket 2015 and rear pocket 2025. Center plate 2060 additionally has notches 2061, a straight area 2062, and bottom bevel 2065 which form the row guide 2120 of cushion back cutter 2000.

In another embodiment, notches on a row guide such as those described above are used in connection with a carpet seam cutter, such as the one shown in U.S. Pat. No. 8,567,075B2 to Hetts et al., which is hereby incorporated by reference in its entirety. FIG. 4 of Hetts shows a loop pile cutter 20000 that includes a blade holder 21000 including a holder right side 21100, a holder center 21300, and a holder left side 21500. Notches, a straight area, and a bottom bevel may be added to center 21300 to reduce shearing of carpet tufts.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A cushion back cutter, comprising:

a first side plate that includes a blade clamp opening and a blade clamp screw passage hole;

a second side plate including a blade screw tapped hole;

a center plate between the first and second side plates, the center plate including a slot that with the first side plate and the second side plate forms a blade holding pocket that has a bottom opening to receive one or more blades, and a blade clamp screw passage hole, the center plate extending from the first and second side plates forming a row guide, the row guide including a plurality of continuous notches along an edge of the row guide;

a blade clamp insertable into the blade clamp opening of the first side plate; and a blade clamp fastener that passes through the blade clamp screw passage hole of the first side plate, passes through the blade clamp screw passage hole of the center plate, and threads into the blade screw tapped hole of the second side plate;

wherein when one or more blades is inserted within the blade holding pocket, the blade clamp screw passage hole of the first side plate, the blade clamp screw passage hole of the center plate, and the blade screw tapped hole of the second side plate are each positioned outside a perimeter of the one or more blades, and wherein when the blade clamp is inserted into the blade clamp opening, tightening of the blade clamp fastener causes the blade clamp to produce pressure on the one or more blades to hold the one or more blades in position.

2. The cushion back cutter of claim 1, wherein the blade clamp includes a blade clamp screw passage hole for the blade clamp fastener, and the blade clamp fastener passes through the blade clamp screw passage hole.

3. The cushion back cutter of claim 1, wherein the blade clamp has an upper portion and an offset lower portion, where the lower portion is insertable into the blade clamp opening.

4. The cushion back cutter of claim 1, wherein the center plate forms a row guide that is beveled.

5. The cushion back cutter of claim 1, wherein the notches have a depth of at least 0.100 of an inch.

6. The cushion back cutter of claim 1, wherein the notches have a continuously rounded contour.

7. The cushion back cutter of claim 1, wherein the center plate comprises at least two pieces.

8. The cushion back cutter of claim 7, wherein the piece of the center plate containing the notches is treated by a batch de-burring process.

9. A cushion back cutter, comprising:

a first side plate;

a second side plate; and a center plate between the first and second side plates, the center plate including a slot that with the first side plate and second side plate forms a blade holding pocket that has a bottom opening to receive one or more blades, the center plate extending from the first and second side plates forming a row guide, the row guide including a plurality of continuous notches along an edge of the row guide.

10. The cushion back cutter of claim 9, wherein the row guide of the center plate additionally includes a straight area that is not notched.

11. The cushion back cutter of claim 9, wherein the notches are beveled.

12. The cushion back cutter of claim 9, wherein the notches have a depth of at least 0.100 of an inch.

13. The cushion back cutter of claim 9, wherein the notches have a continuously rounded contour.

14. The cushion back cutter of claim 9, wherein the center plate comprises at least two pieces.

15. The cushion back cutter of claim 14, wherein the piece of the center plate containing the notches is treated by a batch de-burring process.

16. The cushion back cutter of claim 9, wherein the notches are arranged linearly on a long axis of the row guide.

17. A cushion back cutter comprising: a first side plate; a second side plate; and a center plate between the first and second side plates, the center plate including a slot that with the first side plate and second side plate forms a blade holding pocket that has a bottom opening to receive one or more blades; wherein the center plate has a first side and a second side, and the first side plate is attached to the first side, and the second side plate is attached to the second side, and wherein the center plate extends from the first and second side plates forming a row guide having an edge, where a plurality of continuous notches are formed on the edge of the row guide, and where the plurality of continuous notches pass horizontally from the first side of the edge of the row guide of the center plate through to the second side of the edge of the row guide of the center plate.

* * * * *